US005865222A

United States Patent [19]

Diamond

[11] Patent Number: 5,865,222

[45] Date of Patent: Feb. 2, 1999

[54] FUEL FILL PORT DEVICE THAT PREVENTS OVERFLOW SPILLS DURING FUELING OF MARINE VESSELS

[76] Inventor: Burt Diamond, P.O. Box 1182, Bridgeton, N.J. 08302

[21] Appl. No.: 24,902

[22] Filed: Feb. 17, 1998

[51] Int. Cl.[6] ..... B65B 1/04

[52] U.S. Cl. ..... 141/86; 141/87; 141/311 A; 141/348; 220/86.2; 114/343

[58] Field of Search ..... 141/86, 87, 88, 141/311 A, 301, 348, 349, 350, 98; 220/86.2; 114/343

[56] References Cited

U.S. PATENT DOCUMENTS

| | | | |
|---|---|---|---|
| 5,271,438 | 12/1993 | Griffin et al. | 141/59 |
| 5,322,099 | 6/1994 | Langlois | 141/86 |
| 5,590,698 | 1/1997 | Whitley et al. | 141/86 |

*Primary Examiner*—Steven O. Douglas

[57] ABSTRACT

A fuel fill port device which contains overfill and prevents spillage, mounted by means of a flange through the deck or gunwale on pleasure boats or other marine vessels with internal fuel tanks. The device prevents spillage during fueling by means of an internal storage chamber, an internal sleeve, an independent tube and an independent compression spring located within the port device which together create a unique structure, which prevents overflow spillage during fueling by means of the device temporarily containing and storing the overfilled fuel and automatically flowing the stored fuel into the fuel tank. This is accomplished by strategically aligned chambers, sleeves, tubes and a spring which causes both the alignment and misalignment of positioned holes that when misaligned forms a storage chamber and when aligned forms a conduit directing the stored fuel into the fuel tank. The port device has a cap which when closed seals out all undesirable elements and when removed is tethered to the flange attachment that affixes this port device through the deck or gunwale of the vessel.

5 Claims, 3 Drawing Sheets

FUEL FILL PORT DEVICE THAT PREVENTS OVERFLOW SPILLS DURING FUELING OF MARINE VESSELS

BACKGROUND

1. Field of Invention

This invention relates to a fuel filling port device used for filling internal fuel tanks on pleasure boats and other marine vessels. The device employs a controlled temporary storage chamber that contains the backed up overflowed fuel that occurs during fueling, for a period of time necessary to prevent spilling. Immediately thereafter the device automatically empties the fuel from said storage chamber back into the fuel tank, preventing spilling and subsequent polluting of our waterways.

2. Description of Prior Art

Internal fuel tanks on pleasure boats and other marine vessels have an air vent which allows air and fumes to escape into the atmosphere while fuel is being pumped into the fuel fill port and is displacing the air from within the fuel tank during the fueling operation. The air vent tube is approximately 0.5" diameter, while the fill port tube is approximately 1.5" diameter. As the fuel tank is being filled the boat or vessel tends to rock and list continuously, causing the liquid fuel to slosh back and forth continuously. As this occurs the liquid fuel reaches a level that tops the tank filling inlet, causing momentary false fills, forcing the incoming fuel to back up through the fill hose and spill out of the prior art fill port, spilling fuel both onto the boat and into the waterway. This spilling continues periodically during fueling, depending on the frequency and degree of the marine elements such as, wind, current, wakes from passing boats, and the very movement of the passengers on board. Finally, as the fuel tank actually becomes full, one final spill occurs, which combined with the prior spillage, causes substantial pollution of the surrounding waterway.

The spilling of gasoline fuel in addition to polluting, poses a further potential danger due to its flammability.

Presently, the most common prior art design of fuel filling ports on boats are flanged tubes that fit through and are mounted to the deck or gunwale of the boat above the fuel tank, and are attached below deck by a clamp to a hose that feeds the fuel into the fuel tank, which is commonly found below deck. The flange that enables attachment of the prior art fill tube to the deck or gunwale, is purposely designed with a half inch high circular containment wall on the outer perimeter of the flange with an opening in the wall of approximately three quarters of an inch facing toward the waterway. This is designed so, that when the prior art port fill tube becomes full and a fuel spill occurs the fuel is prevented from spilling into the boat and is directed to spill toward the waterway and away from the boat's interior. Additionally, most prior art fill ports have tethered caps that are attached from the underside of the cap to an attachment within the fill port tube opening, this tether is usually small chain links of sorts that tend to kink during the turning of the cap to unscrew and remove the cap, this kinking of the chain links causes an obstuction and subsequent difficulty of inserting the filling nozzle.

The present method using the prior art port tube to fill the internal fuel tank as found on most pleasure boats and other marine vessels is as follows:

a) The port fill cap is unscrewed, exposing the port fill tube opening, the fill nozzle attached to the fuel fill hose leading from the main pump at the fuel dock is inserted into the port fill tube opening. The trigger on the fill nozzle is then squeezed allowing fuel to flow through the fill port tube inlet, down the hose into the vessel's internal fuel tank.

b) As the fuel filling process takes place, the floating vessel tends to list and rock in many directions caused by various marine elements including: wind, wake from other vessels, tidal currents, and movement from passengers on board. This rocking motion causes the boat to tip or list in various directions, causing the fuel to slosh back and forth and from side to side within the fuel tank, causing the fuel within the tank to momentarily rise up in the interior side of the tank where the filling is taking place, this action causes a momentary false fill and backs the fuel up the fill tube and causes spills out of the filling port tube, causing fuel spills even before the tank is full.

c) As the fuel enters the fuel tank, the existing air within the fuel tank becomes displaced by the incoming fuel and this air is forced to escape via the through hull air vent. As a result of the above mentioned marine conditions however, the 0.5" diameter hose leading to the 0.5" diameter air vent cannot vent as rapidly as the incoming fuel being pressure fed through a 1.5" intake hose. This also results in a "false fill", causing a backup spill at the fill port.

d) The above conditions may take place several times during the fueling process, depending on the frequency of motion caused by the said marine elements and the fuel tank configuration and capacity, eventually resulting in multiple spills during one fill. Studies investigating spillage, as well as observations of the fueling procedure at various busy fuel docks yielded the following results: the fuel dock attendants report that 80 out of 100 boats that are fueled will have spills of several ounces overflowing out of the filling port and into the waterway. For this reason most fuel docks keep cases of a soap product called "Liquid Dawn" available which, when applied directly onto a waterway affected by fuel spillage, helps to camouflage the pollution by dispersing the sheen caused by the fuel spill. The boat owners that were interviewed reported that they spill fuel as well most of the time during fueling.

The U.S. Department of Environmental Protection estimates there are 12 million marine engines in our nations waterways. If only three quarters of them are pleasure boats with internal fuel tanks, with an average of one fueling per week during a six month boating season, during which 75% of each fueling spills on average two ounces of either gasoline or diesel fuel, a tremendous pollution problem results. The above conservative figures, yield the following calculations: 105,468 gallons of gasoline and/or diesel fuel spill per fueling or per week nationwide resulting in a total of 2,531,250 gallons spilling into our waterways per six month boating season. This problem grows with every new boat purchased each year. While there are laws in place to prevent this pollution, they are not being enforced due to a lack of monitoring manpower.

This invention corrects the aforementioned problems by preventing this particular overflow spill pollution from taking place, during fueling.

SUMMARY OF THE INVENTION

The primary objective of this invention is to prevent fuel spills and pollution during fueling of pleasure boats and other marine vessels with internal fuel tanks. This invention prevents spilling during fueling by containing the overflow of fuel in a storage chamber within the fuel fill port device. This is accomplished by means of an independent slideable tube that has a 0.5" diameter hole at the lower end of the wall through which the overflow contained fuel can flow through when the independent slideable tube hole is aligned with the 0.5" diameter hole in the storage chamber inner housing sleeve. The alignment (allowing the flow through) and the misalignment (preventing the flow through) is controlled by a normally expanded independent compression spring that is seated below the independent slideable tube and is the same diameter as the independent slideable tube. As the fuel fill nozzle is inserted into the storage chamber inner housing sleeve it comes to rest on the cross pieces that are attached across the top diameter opening of the independent slideable tube enabling the independent slideable tube to be depressed within the storage chamber inner housing sleeve against the independent compression spring by the weight of the fill nozzle, resulting in the misalignment of the two 0.5" diameter holes and forming a temporary containment storage chamber for the overflowed fuel. As the fill nozzle trigger is shut and the nozzle is lifted, it allows the independent slideable tube to rise via the upward pressure of the normally expanded independent compression spring, to its normal position, aligning the two 0.5" diameter holes and allowing the contained fuel to flow back through to the fuel tank. The vertical alignment of the two 0.5" diameter holes is controlled by a protrusion key at the top outside diameter of the independent slideable tube which communicates with a vertical grooved keyway running from the top inside diameter of the storage chamber inner housing sleeve, for a vertical length that allows the various alignment/misalignment of the two 0.5" diameter holes to take place.

Additional advantages of this invention are:

To prevent pollution by containing the back up of fuel in a containment chamber within the fill port.

To allow the enforcement and monitoring of this type of pollution to become manageable.

To allow ease of installation and replacement of prior art fuel fill port tube.

To provide a fuel fill port device economically fabricated of material that will not be adversely affected by gasoline, diesel fuel and the marine environment.

To provide a fuel fill port device that will seal out moisture, rain, dust and insects when the cap is in place and tightened against an O-ring made of rubber that if said O-ring becomes dry or worn is easily removed for replacement.

To provide a fuel fill port device with a tethered sealing cap tethered from outside the fill port, having no cumbersome cables or chains within the fill port.

To provide a fuel fill port device with a mounting flange structured to accept a grounding attachment.

To allow the independent slideable tube and the independent compression spring beneath said independent slideable tube to be easily removed for examination, or if necessary, eventual replacement.

BRIEF DESCRIPTION OF DRAWINGS FIGS. 1–6

The Invention, a Port Fill Device is shown in the drawings as it would function on a boat with an internal fuel tank. This was done for ease of viewing and understanding the necessity of this invention and in no way suggests that the invention is part of a boat, fuel tank, an attached hose or other parts depicted in the drawings, other than the Port Fill Device as shown.

Figure 1:
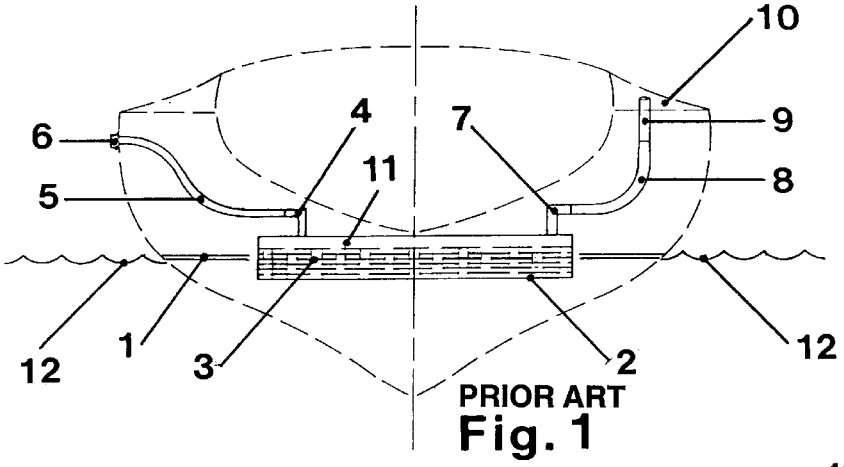
PRIOR ART Fig. 1
FIG. 1 shows a boat cross section illustrating the fuel tank with the air vent to the left, and the prior art fuel fill port tube to the right, lying level in the water and showing the fuel within the tank also lying level.

| Reference Numerals in Drawings | |
|---|---|
| 1 | Boat Hull/Water Line |
| 2 | Fuel Tank |
| 3 | Fuel |
| 4 | Tank Vent Fitting |
| 5 | Tank Vent Hose |
| 6 | Vent |
| 7 | Tank Fill Fitting |
| 8 | Tank Fill Hose |
| 9 | Prior Art Fill Tube |
| 10 | Gunwale Or Deck |
| 11 | Air Space |
| 12 | Water Level |
| 13 | Fill Tube Prior Art Filled With Fuel |
| 14 | False Fill |
| 15 | Invention Fuel Fill Port Device |
| 16 | Backed Up Fuel Spilling |
| 17 | Spill In Water |
| 18 | Fuel Fill Port Device Opening |
| 19 | Fill Nozzle |
| 20 | Cap |
| 21 | Nozzle Trigger |
| 22 | O-Ring |
| 24 | Cap Threads Male |
| 25 | Orifice Threads Female |
| 26 | Outer Housing |
| 27 | Storage Chamber |
| 28 | Inner Housing Sleeve |
| 29 | Continuation Of Inner Housing Sleeve |
| 30 | Groove (Keyway) |
| 31 | Recessed Rim/Ledge Seat |
| 32 | Cross Pieces |
| 33 | Narrow Tube |
| 34 | Independent Slideable Tube |
| 35 | Ridges To Grip Hose |
| 36 | Hole through Storage Chamber Inner Housing Sleeve |
| 38 | Hole Through Independent Slideable Tube |
| 40 | Independent Compression Spring |
| 42 | Hose |
| 44 | Hose Clamp |
| 46 | Protrusion (Key) |
| 48 | Flange With Mounting Holes |
| 49 | Locking Nut |
| 50 | Screw |
| 51 | Slots |
| 52 | Tether Cable |
| 53 | Loop |
| 54 | Swivel Loop |
| 55 | Rubber Gasket |
| 56 | Threaded Hole |

DETAILED DESCRIPTION OF THE INVENTION

FIG. 1 shows a boat cross section which enables viewing of the internal fuel tank 2, the fuel 3 level within the fuel tank 2, a tank vent fitting 4, attached tank vent hose 5 leading to the vent 6. A tank fill fitting 7, attached to tank fill hose 8 leading to the prior art fill tube 9, extending and attached through gunwale 10; also showing the boat hull/waterline 1, lying level with the water level 12, causing the fuel 3 within the fuel tank 2 also to be level, and showing the air space 11 within the fuel tank 2.

Figure 2:
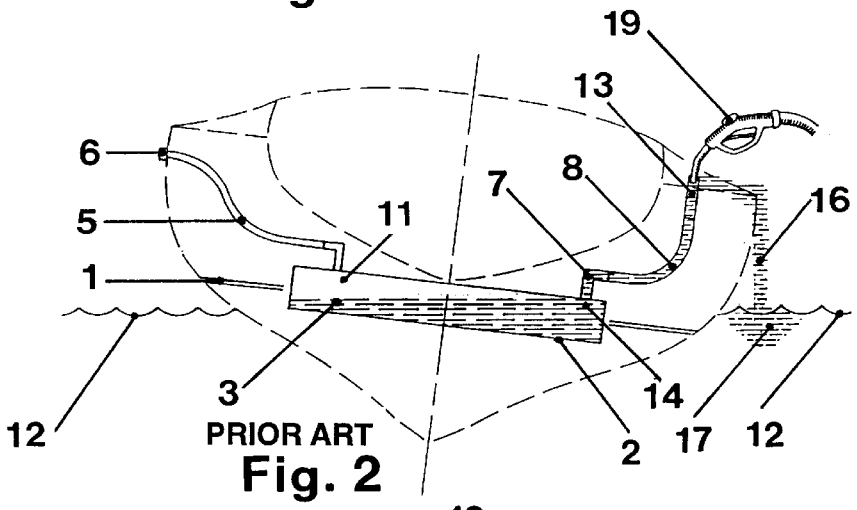
PRIOR ART Fig. 2
FIG. 2 shows a boat listing, creating a false fill and spill with prior art style fill port tube showing overflow spillage during fueling.

FIG. 2 describes the same boat cross section, with the boat listing to one side showing the following differences from FIG. 1; the fuel 3 due to the direction of the list of the boat creates a false fill 14 backing the fuel 3 up into tank fill fitting 7, tank fill hose 8 and fill tube prior art filled with fuel 13, with fuel nozzle 19 inserted and nozzle trigger 21 turned on, flowing fuel 3 into prior art fill tube 9 causing backed up fuel spilling 16 and a spill in water 17. Note the hull/water line 1 in relation to the water level 12. Boats tied to fuel docks where there is continuous boat traffic causing wakes lists and rocks from side to side continuously.

Figure 3:
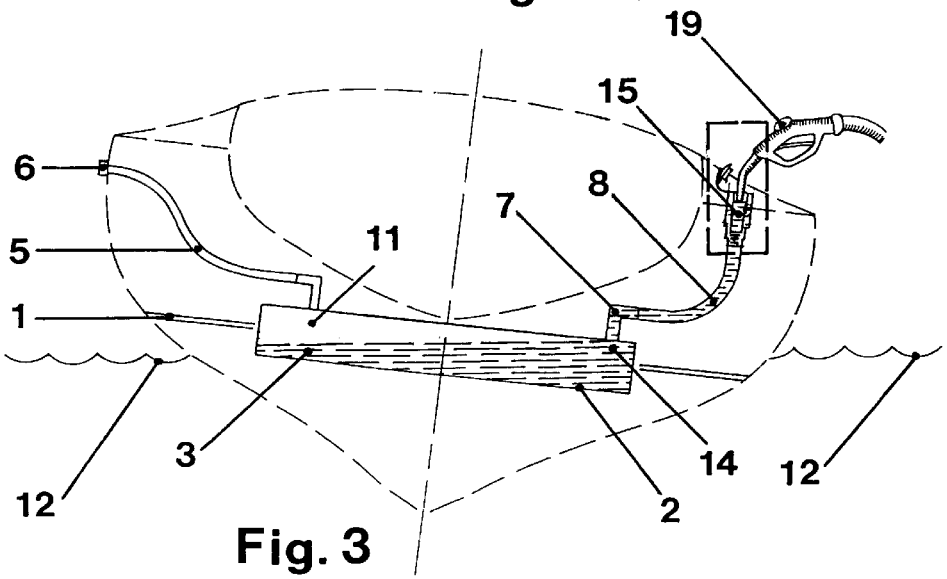
FIG. 3 shows a boat listing, creating a false fill with the embodiment of this invention, the fuel fill port device containing the overflow and preventing spillage during fueling.

FIG. 3 shows the same boat cross section as FIG. 2 with the boat listing to one side, with the introduction of the invention fuel fill port device 15 preventing a spill, see inset.

Figure 4:
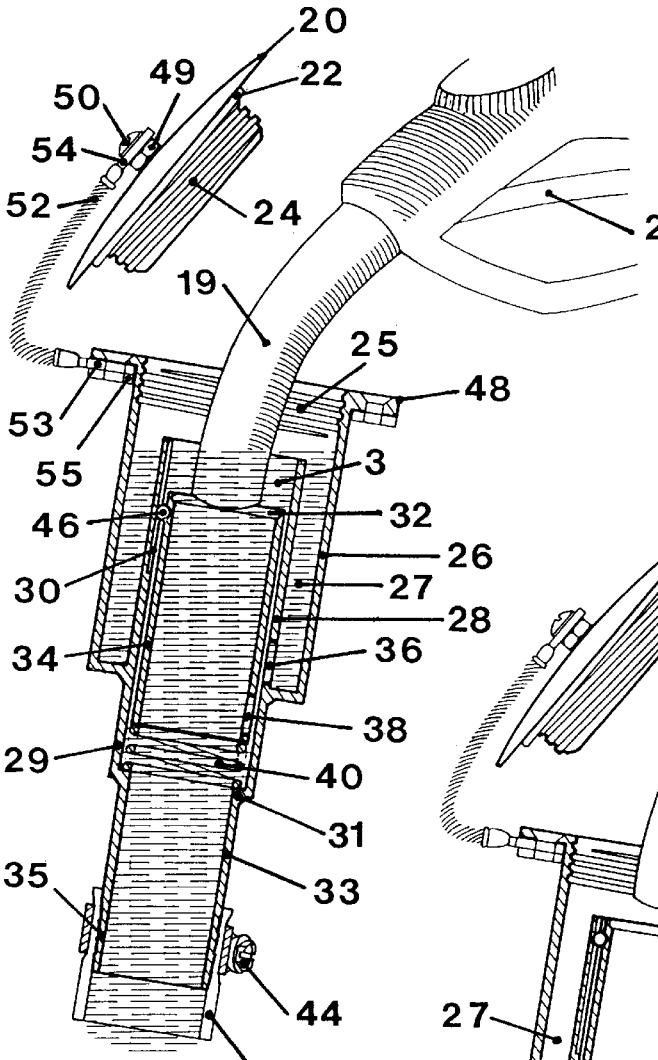
FIG. 4 is an enlarged cross sectional view of the inset of FIG. 3 showing the overflowed fuel being contained in the storage chamber created by the misalignment of two 0.5" diameter holes of the fuel fill port device of this invention.

FIG. 4 is an enlarged cross sectional view of the inset of FIG. 3 describing the invention a fuel fill port device 15 as it is being filled with fuel 3 from fill nozzle 19 showing nozzle trigger 21 in the on position, as the fuel 3 backs up into the independent slideable tube 34 and overflows the inner housing sleeve 28, the overflowed fuel 3 spills into storage chamber 27 and is contained. Storage chamber 27 is made to store when the fill nozzle 19 is rested against cross pieces 32 which are found affixed to the top diameter orifice of independent slideable tube 34. Fill nozzle 19 is then turned on by pressing nozzle trigger 21 while applying the fill nozzle 19 down against cross pieces 32. Independent slideable tube 34 is able to be pressed down as it rests upon independent compression spring 40 which in turn rests upon and is stopped by recessed rim/ledge seat 31. Independent slideable tube 34 retains its vertical position without twisting by means of protrusion key 46 which is found on the outside diameter at the very top of the independent slideable tube 34. Protrusion key 46 aligns with and fits into groove keyway 30 which is found on the inside diameter of inner housing sleeve 28 and runs down vertically for a length that is necessary to misalign the hole through independent slideable tube 38 with the hole through storage chamber inner housing sleeve 36. This misalignment of holes creates storage chamber 27. As the false fill 14 occurs and the fuel 3 backs up and runs over inner housing sleeve 28 into storage chamber 27 the fill nozzle 19 is manually shut off by releasing nozzle trigger 21, and is removed, causing independent compression spring 40 to expand upward against recessed rim/ledge seat 31 thereby pushing independent slideable tube 34 to its normal position which aligns hole through storage chamber inner housing sleeve 36 with hole through independent slideable tube 38 forming a conduit which directs the stored fuel 3 to flow through and return to the fuel tank 2 as the boat continuously lists and rocks from side to side as shown in FIG. 5.

Figure 5:
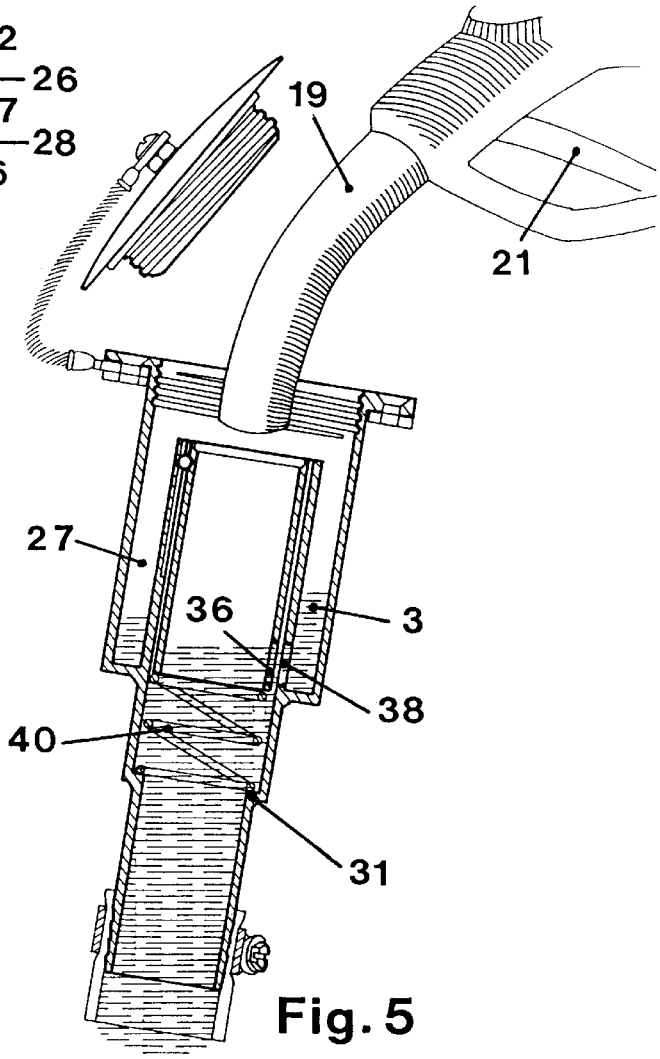
FIG. 5 is an enlarged cross sectional view of the inset of FIG. 3 showing the shutting and removal of the fill nozzle which causes the alignment of the two 0.5" diameter holes which creates a conduit and returns the stored overfilled fuel to the fuel tank.

FIGS. 4 & 5 also show tethered cap 20 which seals the fuel fill port device opening 18, with slots 51 for turning to open or close and a sealing o-ring 22, cap threads male 24, threaded hole 56, screw 50 and locking nut 49, which hold the tether swivel loop 54. The other end of tether cable 52 connects to a loop 53 which is attached to the underside of the flange with mounting holes 48 and is connected above the gunwale or deck 10 and sandwiched on its under side between the flange 48 and the gunwale or deck 10 with a rubber gasket 55. The fuel fill port device housing 26 has at its inside top orifice thread female 25 that accept the male threads of cap 20 for closure or opening of the fuel fill port device 15. Outer housing 26 containing and a part of inner housing sleeve 28 and continuation of inner housing sleeve 29 which is connected to narrow tube 33 having exterior circumferential ridges to grip hose 35, also showing is attachment to hose 42 by means of hose clamp 44 leading to fuel tank 2.

Figure 6:
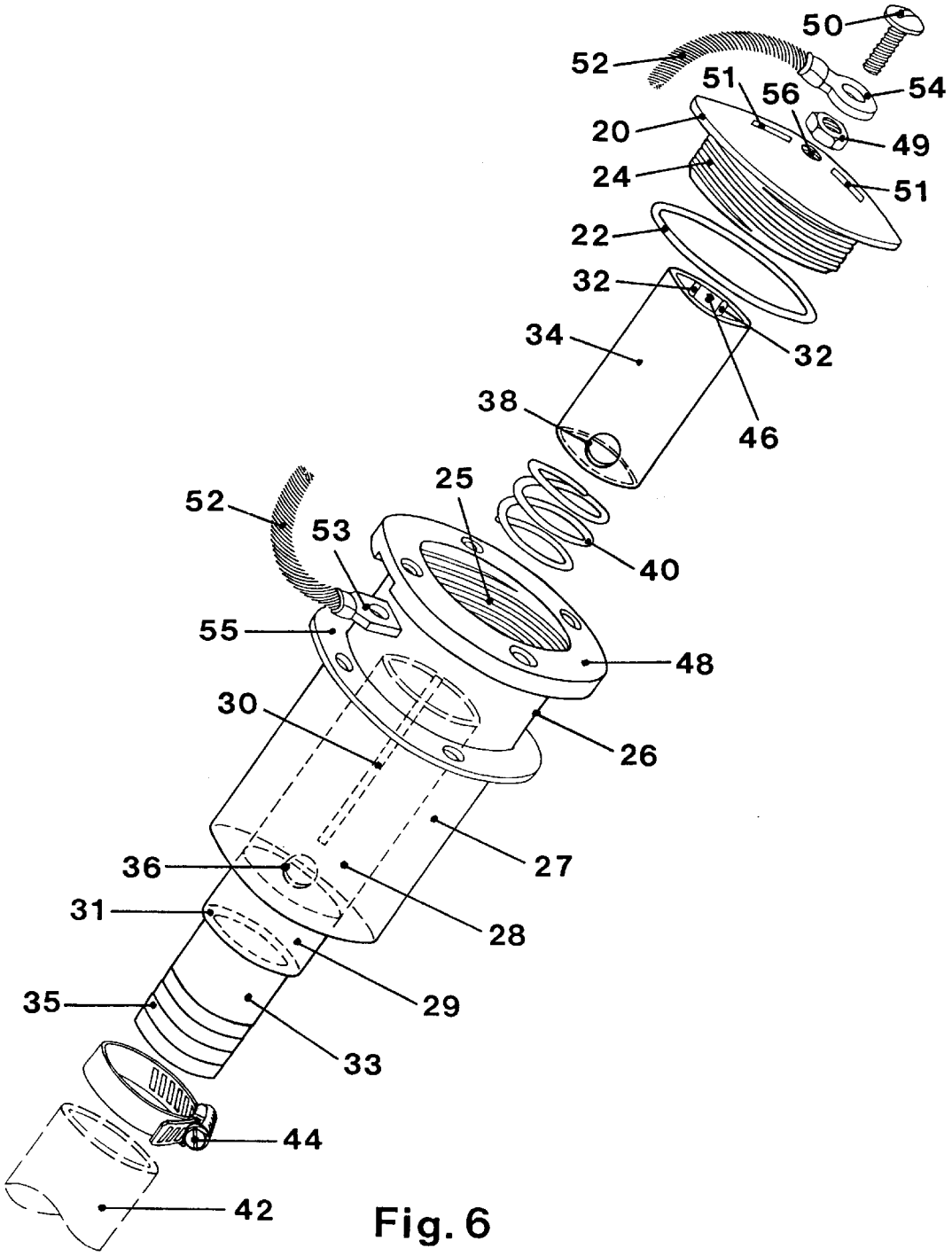
FIG. 6 is an exploded perspective view of the embodiment of this invention, an overfill and spillage containment port device.

FIG. 6 is an exploded view of the embodiment of the invention, specifically refer to several key elements; the hole through storage chamber inner housing sleeve 36 and the hole through independent slideable tube 38 maintain a fixed vertical position governed by groove/keyway 30 and protrusion key 46. The hole through storage chamber inner housing sleeve 36 and hole through independent slideable tube 38 which rests on independent compression spring 40 are of the same diameter and are normally aligned with each other when independent compression spring 40 is in its normally expanded relaxed position, as to form a conduit which does not allow any fuel 3 to remain within storage chamber 27.

I claim:

1. A fill port device used to fill an internal fuel tank on a motile marine vessel with liquid fuel while preventing overfill spillage, said port device comprising a member adapted to extend through an opening in the deck or gunwale or other suitable hull position of said vessel, said member further being comprised of several various sized interconnected rigid tubes, an independent slideable tube and an independent compression spring which together when activated creates a chamber formed between said slidable tube and said rigid tubes to contain overflowed fuel and when deactivated allows said contained fuel to flow from said chamber into said fuel tank, wherein when activated a fuel filling nozzle is in cooperation with said device and when deactivated a fuel filling nozzle is removed from said device.

2. The port device of claim 1 further being adapted to be attached from above said deck or gunwale allowing filling, extends through said opening exiting below said deck or gunwale or other suitable position above said internal fuel tank allowing a gravity flow of said fuel into said fuel tank, said member having a main housing with an inner rigid tube end adapted to extend through said opening and an outer end comprising a circumvallating flange with means for attachment from above to said deck or gunwale circumventing a top orifice of said main housing and further being adapted to transport said liquid fuel from above said deck or gunwale where filling begins through said member to an attached flexible hose below said deck or gunwale leading to said fuel tank.

3. The fill port device of claim 1, wherein the interconnected rigid tubes comprises one lower tube of a lesser diameter, attached to one upper tube of a larger diameter to create a circular ledge rest where attachment occurs forming a stop for the bottom circumference of said independent compression spring to seat against, the inside diameter of said upper tube being the same as said independent compression spring's outside diameter to create a snug fit therebetween.

4. The fill port device of claim 3, wherein the independent slideable tube comprises several narrow diameter cross pieces attached across its top orifice to allow the fuel filling nozzle a surface to press against thereby depressing said independent slideable tube against said independent compression spring urging said independent compression spring to a position that lowers said independent slideable tube, allowing a small hole in of said independent slideable tube to align with an equal sized small hole in said storage chamber, said holes when misaligned due to the urging by said fuel filling nozzle against said cross pieces found atop said independent slideable tube creates said storage chamber, when said fuel filling nozzle is removed and said independent compression spring decompresses, said holes align with each other creating a conduit allowing said contained fuel to gravity flow into said fuel tank, said independent slideable tube cannot turn within said internal sleeve clockwise nor counter clockwise due to inclusion of a protrusion key found at the top exterior of said independent slideable tube which communicates with a vertical grooved keyway found on the interior wall of said internal sleeve, assuring the precision alignment of both said holes.

5. The port device of claim 1 further comprising a male threaded cap which communicates with a female thread found at a top orifice of said port device, said cap having slotted grooves across said cap's top diameter to enable a means for insertion of any flat tool for either opening or securly closing said cap to said top orifice of said port device, a rubber O-ring disposed above said male threads to insure a sealed closure, said threaded cap is fitted with a swivel mounted to a bolt found at a top axis of said threaded cap, said swivel being attached to a tether cable, said tether cable further being attached to the underside of a flange, said flange further having holes for attachment to said marine vessel.

* * * * *